US005924688A

United States Patent [19]

Weijers

[11] Patent Number: 5,924,688

[45] Date of Patent: Jul. 20, 1999

[54] REVERSING DEVICE FOR SHEETS OF PAPER, INTENDED PARTICULARLY FOR PRINTING DEVICES

[75] Inventor: Jacques R.M.G. Weijers, Maasbree, Netherlands

[73] Assignee: OCE-Technologies, B.V., Venlo, Netherlands

[21] Appl. No.: 08/870,826

[22] Filed: Jun. 6, 1997

Related U.S. Application Data

[30] Foreign Application Priority Data

Jun. 7, 1996 [NL] Netherlands ..... 1003297

[51] Int. Cl.[6] ..... B65H 29/00

[52] U.S. Cl. ..... 271/184; 271/303; 271/902

[58] Field of Search ..... 271/184, 185, 271/186, 902, 300, 303

[56] References Cited

U.S. PATENT DOCUMENTS

| | | | |
|---|---|---|---|
| 4,456,236 | 6/1984 | Buddendeck . | |
| 4,486,012 | 12/1984 | Bock et al. | 271/186 |
| 4,487,506 | 12/1984 | Repp et al. | 271/3.03 |
| 5,303,017 | 4/1994 | Smith | 271/186 |
| 5,381,209 | 1/1995 | Binder et al. . | |

FOREIGN PATENT DOCUMENTS

| | | | |
|---|---|---|---|
| 4125451A1 | 2/1993 | Germany . | |
| 61-116661 | 7/1986 | Japan . | |
| 62-17663 | 2/1987 | Japan . | |
| 404059538 | 2/1992 | Japan | 271/186 |
| 4-308147 | 10/1992 | Japan . | |
| 404308149 | 10/1992 | Japan | 271/902 |
| 405294531 | 11/1993 | Japan | 271/186 |

*Primary Examiner*—H. Grant Skaggs
*Attorney, Agent, or Firm*—Birch, Stewart, Kolasch & Birch, LLP

[57] ABSTRACT

A reversing device for at least one sheet of paper, intended particularly for inclusion in a scanner in a printing device such as a printer or a copying machine. The reversing device has a first guide for guiding one or more paper sheets along a feed path in a first direction. A roller system is also provided and is disposed downstream from the first guide. The roller system defines a transport nip and comprises at least one driven roller which is adapted to be driven selectively in two opposite directions of rotation for selectively driving the sheet of paper respectively in a second direction and a third direction. The second direction has a component which is in the first direction, and the third direction is opposite to the first direction. A second guide is also provided for guiding the paper sheet in a fourth direction which has a component in the third direction. When moving in the fourth direction, the paper sheet moves along a discharge path which is different from the feed path. The reversing device further comprises an operating device for the second guide which will bring the second guide of and into an operative position for transporting the paper sheet in the second direction and the third direction.

17 Claims, 1 Drawing Sheet

REVERSING DEVICE FOR SHEETS OF PAPER, INTENDED PARTICULARLY FOR PRINTING DEVICES

FIELD OF THE INVENTION

The invention relates to an reversing device for paper sheets, intended particularly for inclusion in a printing device having a scanner, such as a scanner/printer or a copying machine.

DESCRIPTION OF THE BACKGROUND ART

Reversing devices for sheets of paper are known. U.S. Pat. No. 4,456,236, for example, describes a reversing device used to enable duplex paper sheets, after they have been taken through a scanner, to be fed with the opposite side through the scanner via a looped guide. A roller system rotatable in two directions is disposed directly downstream of the scanner. A deflecting structure is located between the roller system and the scanner and is formed by an elongate guide member which forms the paper sheet guide in the first part of the looped inverting path. The deflecting structure is disposed rotatable about a fixed pin,, and forms the actual deflector by the downwardly hanging end. This downwardly hanging end usually extends as a result of gravity within the path taken by a duplex paper sheet after it has just been scanned for the first time and is fed through the nip. The sheet of paper forces the downwardly hanging end of the guide part up out of the associated path. After the trailing edge of the paper sheet has passed the downwardly hanging end of the guide part, the part will again fall under the influence of gravity. The drive rollers are then rotated in the opposite direction so that the trailing edge of the paper sheet becomes the leading edge. This leading edge extends above the downwardly hanging end of the guide part and will be forced obliquely upwards by the guide part in order to pass through the looped path.

This known inverting device is operated by the product being treated and by the dead weight of the guide part. As a result, the reliability of the known device is not always sufficient and the device is susceptible to trouble as a result of the considerable risk that paper sheets will jam. Also, the guide part can readily damage the paper sheet moving past it and/or an image on the paper sheet.

SUMMARY OF THE INVENTION

The object of the present invention is to provide a reversing device which can operate in a reliable and trouble-proof manner and will not cause any damage to the paper sheet during reversing. To this end, the present invention provides a reversing device for sheets of paper, intended particularly for inclusion in a printing device such as a printer or a copying machine, or more particularly for inclusion in a scanner of a printing device. The reversing device comprises first guide means for guiding one or more paper sheets along a feed path in a first direction, a system of rotatable members disposed downstream thereof and defining a transport nip, said system comprising at least one directly driven rotatable member which is adapted to be driven selectively in two opposite directions of rotation for selectively driving the sheet of paper respectively in a second direction having a component in the first direction, and in an opposite third direction, and second guide means for guiding the paper sheet in a fourth direction having a component in the third direction, along a discharge path different from the feed path, further comprising operating means for the second guide means in order to bring the same respectively out of and into an operative position for transporting the paper sheet in the second direction and the third direction when the drive is operative.

In the reversing device according to the invention, the second guide means required to guide the sheet of paper or stack of sheets of paper in the opposite direction are brought into and out of their operative position with the aid of extra operable means. As a result, the reversing device is independent of the paper thickness for its operation and will be able to function reliably over a long period.

In a further development of the reversing device according to the invention, the operating means are disposed on the rotatable shaft of one of the rotatable members, preferably a drive shaft. This eliminates the need for complicated and bulky transmission mechanisms.

In this connection, preferably, the second guide means comprise a guide surface which is at least partially, as considered in the second direction, upstream of the transport nip and is formed on tilting means which are disposed pivotably about a point, wherein the guide surface in the inoperative position is situated below the horizontal plane through the transport nip. In that case, gravity can be utilized to bring the guide surface to the most frequent inoperative position and temporarily hold it.

Preferably, the pivot point is situated beneath the horizontal plane through the transport nip passage. Consequently, the tilting means can be kept completely beneath and outside the transport nip, so that the passage of sheets of paper is not obstructed as a result and the construction of the reversing device which can be kept simple.

Preferably, the tilting means comprise flap means, wherein the pivot point, as considered in the second direction, is situated downstream of the transport nip. Thus, the guide surface and the pivot point will be situated on either side of the driven rotatable member, thus again limiting the space required in the processing directions.

Preferably, the operating means are provided with means for temporarily lifting the flap means against the force of gravity when the second guide means are brought into and temporarily held in the operative position. Advantageously the lifting means comprise at least one cam which is disposed on the shaft and is provided with a support surface for the flap means, the support surface comprising first and second support surface parts disposed at a different radial distance from the center line of the shaft.

Preferably, the first support surface part is cylindrical and is concentric with respect to the shaft, wherein the second support surface part is closer to the shaft than the first support surface part and as considered in the second direction, is situated upstream thereof. In the inoperative position, the flap means can be supported at a distance from the nip, for lifting on reversal of the drive direction, with accompanying rotation of the cam, and vice versa.

Preferably, the first support surface part has a radius coinciding substantially with the radius of the rotatable member belonging to the shaft. Preferably, the second support surface part forms part of a flat surface extending tangentially with respect to the shaft.

According to a further development of the reversing device according to the invention, the cam is disposed on the shaft by means of a frictional or slip connection. In this case, the reversing device comprises stationary stop means, wherein the cam is provided with first and second abutment means fixed thereto and facing opposite directions in the direction of rotation of the shaft and are spaced apart in the direction, the stop means being situated within the rotary path of the first and second abutment means. On reversal of the drive direction of the rotatable member, the cam will then be co-rotated as a result of the frictional connection until it contacts the stop means by one of the two abutment means. The cam then stops in that rotational position while the driven rotatable member continues to rotate. On reversal of the drive direction again, the same conditions apply in the reverse direction.

Preferably, to achieve the frictional connection between the cam and the driven shaft, the cam is substantially annular with a radially continuous recess. The cam is made from a springy material, such as rubber, and is clamped around the shaft and wherein stop means extend within the recess. The first and second abutment means each have abutment surfaces, a normal direction of which is directed tangentially or has a radially inwardly directed component. In this case, the stop means will force the cam to open on abutment and on continuing rotation and hence engagement of the cam by the shaft so that the frictional connection is largely eliminated and the shaft and the roller are scarcely obstructed, if at all, in their continuing rotation.

The invention also relates to a printing device provided with an reversing device according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention. FIGS. 1 to 4 of the drawings show the exemplified embodiment of the inverting device according to the present invention in four successive stages of use, in which:

FIG. 1 shows the reversing device of the present invention upon feeding of a sheet to the reversing device;

FIG. 2 shows the reversing device of the present invention when a majority of the sheet has been fed to the reversing device;

FIG. 3 shows the reversing device of the present invention when a direction of feed for the reversing device has been changed; and FIG. 4 shows the reversing device of the present invention when the sheet is being fed from the reversing device.

DETAILED DESCRIPTION OF THE PREFERRED EMBODIMENTS

Figure 2:
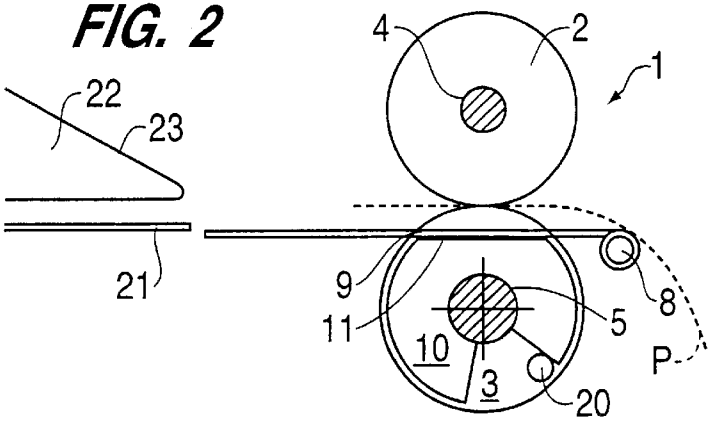
Figure 1:
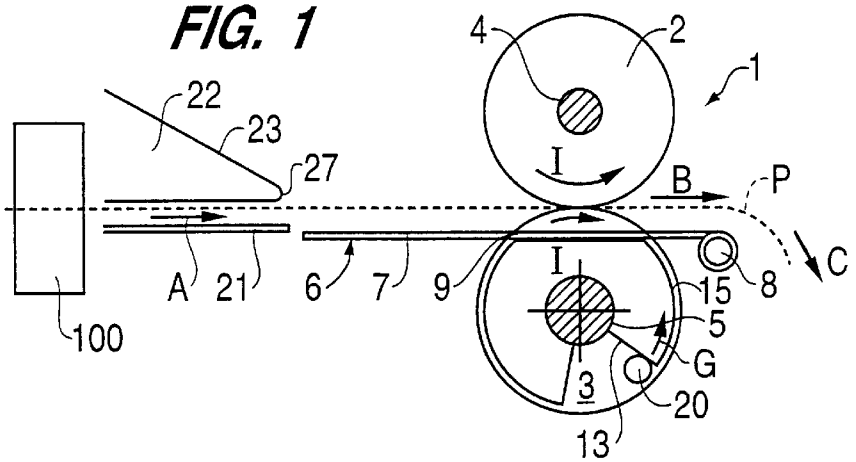
Figure 4:
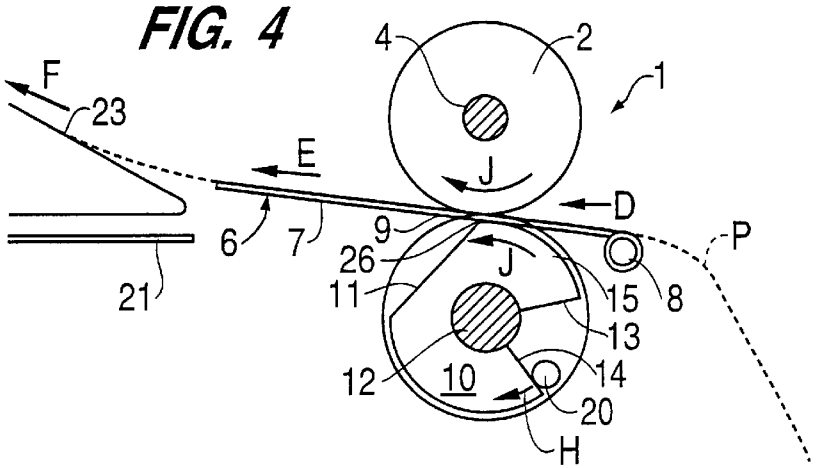

In FIG. 1, the reversing device 1 is disposed after a scanner 100 of a copying machine. One side of the original paper sheet P is read in the scanner 100. The reversing device 1 is designed to remove a read original at the side of the scanner from which the original was originally fed into the scanner. In order to feed the other side of a sheet P, such as a duplex original paper sheet, through the scanner 100 again in the inverted sense, the paper sheet P is returnable in the direction F as indicated in FIG. 4 in order to be fed, in the case of a duplex original, along the scanner 100 again in the inverted sense by means of a looped path (not shown).

Considered in the first direction A, guide means in the form of a guide plate 21 are disposed after the scanner 100. Above the guide plate 21 is a reversing guide 22 provided with an oblique guide surface 23, which starts at nose 27.

Spaced from this is a driven set of rollers 2, 3, which form a nip. The nip is in this case in line with the direction A. The rollers 2 and 3 are respectively disposed on shafts 4 and 5, of which at least one, for example, shaft 5 is driven by drive means (not shown). It will be clear that the rollers 2 and 3 can be formed by a plurality of rollers disposed next to one another in the axial direction. The rollers 2 and 3 can be driven in controllable and selected manner in two opposite directions I, J.

Beneath the nip is a deflector flap 6, which is hingeably fixed at the downstream side of the rollers 2 and 3 at the location of fixed pins 8. A support surface 9 is provided at the bottom and a guide surface 7 is at the top of the deflector flap 6. In the position shown in FIG. 1, the deflector flap 6 is situated completely below the horizontal plane through the nip of the rollers 2 and 3. Thus in the case of transport in direction A, which is the most frequently required (in any case it is always required with simplex originals) the deflector flap 6 is in the inoperative state and then does not form an obstacle. In contrast to the conditions applicable to the guide surface 7, it is not necessary for the support surfaces 9 to coincide vertically with the path followed by the paper sheet P. It will be clear that there are a number of possible connections possible between the guide surface 7 and the hinge pins 8. Of course, only one pin 8 could be used if so desired.

At the support surface 9, a rubber cam 10 is disposed on the (drive) shaft 5 of roller 3. The cam 10 is clamped with the inner peripheral surface 12 around the outer surface of the drive shaft 5. The cam 10 is provided with circular cylindrical surfaces 15, 16 between which a tangentially extending support surface 11 is situated, which merges into surface 15 at the end edge 26. The surface 15, 16 can be considered a first support surface part and the surface 11 can be considered a second support surface part. The cam 10 is in the form of an open ring, in which a radially continuous recess 24 is bounded by abutment first and second surfaces 13 and 14 extending in the radial direction.

A stop 20 is mounted to be stationary in the reversing device 1 in manner not shown. This stop 20 extends axially inside the recess 24.

The reversing device 1 operates as follows. The rollers 2 and 3 rotate in the directions I on transport of a sheet through the scanner 100. As a result of the friction between the inner surface 12 of the cam 10 and the rotating shaft 5, the cam 10 is co-rotated and forced against the pin 20 by abutment surface 13. As a result, a force G is exerted on the rubber cam 10 so that the latter is pressed open to some extent, with the result that the frictional force exerted on the rotating shaft 5 by the inner surface 12 is largely cancelled.

In the situation shown in FIG. 1, the deflector 6 is situated completely beneath the horizontal plane through the nip of the rollers 2 and 3. In these conditions the deflector flap 6 rests in stable manner by support surface 9 on the flat support surface 11 of the cam 10. In these conditions the paper sheet P is transported in the first direction A and through the rollers 2 and 3 in the second transport direction B, C which in this case has a component B which coincides with the first direction A. When moving in the second transport direction, the paper sheet P will bend downwardly as indicated by component C by the front zone.

When the rear zone of paper sheet P has arrived at the nip, the rollers 2 and 3 are stopped. The direction of rotation of the rollers 2 and 3 is then reversed, so that they rotate in the direction J and the actual direction of transport in the nip is a third direction D. This third direction D is opposite to the first direction A.

Figure 3:
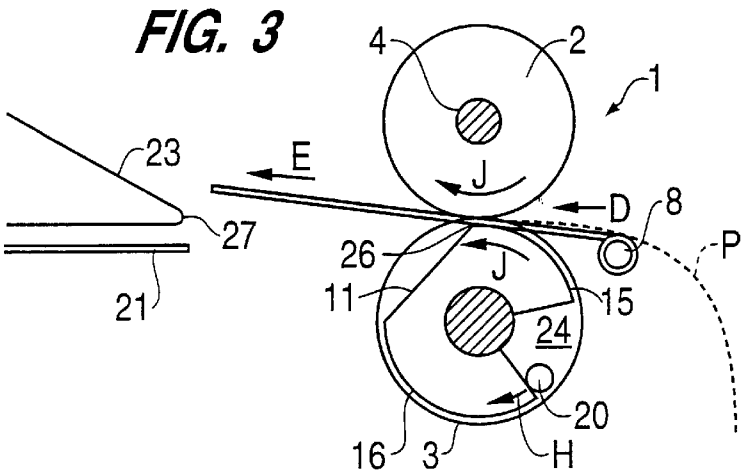

In this opposite direction of rotation, the cam 10 will be released from the stop 20 and again be able to bear by the inner surface 12 snugly against the shaft 5. This mutual engagement is enhanced by the force exerted by the deflector flap 6 on the cam 10 at the support surface 9 when the cam tends to rotate in the counter-clockwise direction. As a result, the cam 10 is further entrained in the rotation direction J and the support surface 11 will turn downwards away from the support surface 9. Initially, the end edge 26 forming the transition between the support surface 11 and the circular support surface 15 will engage the support surface 9 and hence automatically lift it until the circular surface 15 completely engages the support surface 9, and the deflector flap 6 retains its orientation in static a manner. Continuing rotation of the cam 10 in the direction J is prevented because the other abutment surface 14 of the cam 10 has reached the other side of the stop 20 as shown in FIG. 3. In response to this, the stop 20 then exerts on the abutment surface 14 a force in the direction H so that, just as was the case in FIG. 1, the cam 10 will be open to some extent and further rotation of shaft 5 and roller 3 is not appreciably obstructed.

The rear zone of the paper sheet P had passed through the rollers 2 and 3 and will be transported back in the fourth direction E. This fourth direction E has a component which is in the third direction D. As a result of the tilted position of the deflector flap 6, the rear zone of paper sheet P is, however, held above the nose 27 at the end of the feed path, so that paper sheet P is transported back obliquely upwards in the direction F supported by guide surface 23.

After the paper sheet 1 has completely left the nip the direction of rotation of the rollers 2 and 3 can again be in direction I, so that the force H on abutment surface 14 and cam 10 is eliminated and cam 10 engages the shaft 5 to rotate therewith until the abutment surface 13 again arrives against the stop 20 and the support surface 11 has returned to the position shown in FIG. 1. Under the influence of gravity, the deflector flap 6 is automatically turned back into the position shown in FIG. 1, in which a following sheet of paper P can move unobstructedly to the nip.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A reversing device for sheets of paper for use in a printing device with a scanner, the reversing device comprising:

first guide means for guiding at least one paper sheet along a feed path in a first direction;

a system of rotatable members disposed downstream of the first guide means, the system of rotatable members defining a transport nip, said system comprising at least one directly driven rotatable member, the at least one directly drive rotatable member being selectively drivable in two opposite directions of rotation for selectively driving the paper sheet respectively in a second direction and a third direction, the second direction having a component in the first direction, and the third direction being opposite to the first direction;

second guide means for guiding the paper sheet in a fourth direction along a discharge path which is different from the feed path, the fourth direction having a component in the third direction, the second guide means includes tilting means pivotably mounted about a pivot point, the tilting means extending from the pivot point in a direction opposite to the first direction, the second guide means having a guide surface, the guide surface being at least partially upstream of the transport nip as considered in the second direction, the guide surface in the inoperative position being situated below a generally horizontal plane through the transport nip;

operating means for moving the second guide means between an operative position and an inoperative position for transporting the paper sheet in the second direction and the third direction when the at least one directly driven rotatable member is driven; and a rotatable shaft, the operating means and at least one rotatable member being disposed on the rotatable shaft, the at least one directly drive rotatable member being mounted on the rotatable shaft with the operating means.

2. The reversing device according to claim 1, wherein the pivot point is situated beneath the generally horizontal plane through the transport nip.

3. The reversing device according to claim 1, wherein the tilting means comprise a flap and wherein the pivot point is situated downstream of the transport nip as considered in the second direction.

4. The reversing device according to claim 3, wherein the operating means is provided with means for temporarily lifting the flap against a force of gravity when the second guide means is brought into and temporarily held in the operative position.

5. The reversing device according to claim 4, wherein the rotatable shaft has a center line and wherein the lifting means comprises at least one cam which is disposed on the shaft, the at least one cam having a support surface for the flap, the support surface comprising first and second support surface parts disposed at different radial distances from the center line of the shaft.

6. The reversing device according to claim 5, wherein the first support surface part is generally cylindrical and is concentric with respect to the shaft and wherein the second support surface part is closer to the shaft than the first support surface part.

7. The reversing device according to claim 6, wherein the first support surface part has a radius coinciding substantially with a radius of a surface of the rotatable member which is on the shaft.

8. The reversing device according to claim 7, wherein the second support surface part is generally a flat surface extending tangentially with respect to the shaft.

9. The reversing device according to claim 5, wherein the at least one cam is disposed on the shaft by a frictional or slip connection.

10. The reversing device according to claim 9, further comprising stationary stop means, the cam being provided with first and second abutment means fixed to the cam, the first and second abutment means being spaced apart and facing opposite directions with respect to a direction of rotation of the shaft, the first and second abutment means being movable about a rotary path and the stop means being situated within the rotary path of the first and second abutment means.

11. The reversing device according to claim 10, wherein the cam is substantially annular with a radially continuous recess, the cam being made from a springy material and being clamped around the shaft, the stop means extending within the recess, the first and second abutment means each having an abutment surface, a normal to each of the abutment surfaces being directed tangentially or with a radially inwardly directed component.

12. The reversing device according to claim 11, wherein the cam is made of rubber.

13. The reversing device according to claim 1, wherein the guide surface in the operative position is situated in a plane passing through the transport nip.

14. The reversing device according to claim 1, wherein the system of rotatable members is a roller system.

15. A printing device provided with the reversing device according to claim 1.

16. A copying machine provided with a scanner and the reversing device disposed downstream thereof according to claim 1.

17. A printer provided with the reversing device according to claim 1.

* * * * *